US006477340B2

(12) United States Patent
Tomizawa et al.

(10) Patent No.: US 6,477,340 B2
(45) Date of Patent: Nov. 5, 2002

(54) IMAGE FORMING APPARATUS HAVING EMERGENCY STOP IMAGE PROCESSING FEATURES

(75) Inventors: Takeshi Tomizawa, Numazu (JP); Jun Mochizuki, Shizuoka-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/826,087

(22) Filed: Apr. 5, 2001

(65) Prior Publication Data

US 2001/0048821 A1 Dec. 6, 2001

(30) Foreign Application Priority Data

Apr. 7, 2000 (JP) ..... 2000-106809

(51) Int. Cl.[7] ..... G03G 15/16
(52) U.S. Cl. ..... 399/66; 399/101; 399/302
(58) Field of Search ..... 399/101, 66, 302, 399/308

(56) References Cited

U.S. PATENT DOCUMENTS 5,559,590 A * 9/1996 Aroi et al. ..... 399/66 X
5,970,278 A * 10/1999 Munakata ..... 399/66 X
6,035,154 A * 3/2000 Takahata et al. ..... 399/66
6,148,159 A * 11/2000 Shiraishi ..... 399/66 X
6,321,059 B1 * 11/2001 Tamura ..... 399/302 X
6,341,207 B1 * 1/2002 Sasaki et al. ..... 399/149

* cited by examiner

*Primary Examiner*—Fred L Braun
(74) *Attorney, Agent, or Firm*—Fitzpatrick, Cella, Harper & Scinto

(57) ABSTRACT

An image forming apparatus includes a plurality of image bearing members, a plurality of image forming portions for forming images on the plurality of images of image bearing members, a plurality of primary transfer portions for transferring the images on the plurality of image bearing members onto an intermediate transfer member, secondary transfer portions for transferring the image on the intermediate transfer member onto a transfer material, and a controller. The controller controls the primary transfer portion to operate until an image area on the image bearing member on which an image is being formed at the point when an image formation stop instruction is issued passes a transfer region in the primary transfer portion opposing the image bearing member.

19 Claims, 10 Drawing Sheets

ON AND OFF OF BIAS (FOR TWO SHEETS OF A4 SIZE)

NORMAL OPERATION

AT EMERGENCY STOP

ON AND OFF OF BIAS (FOR TWO SHEETS OF A4 SIZE)

NORMAL OPERATION

AT EMERGENCY STOP

ON AND OFF OF BIAS (FOR TWO SHEETS OF A4 SIZE)

NORMAL OPERATION

AT EMERGENCY STOP

IMAGE FORMING APPARATUS HAVING EMERGENCY STOP IMAGE PROCESSING FEATURES

BACKGROUND OF THE INVENTION

Field of the Invention

The present invention relates to an image forming apparatus such as a copying machine, a printer and a facsimile machine using an electrophotographic method. In particular, the present invention relates to an image forming apparatus of an intermediate transfer method with which a visible image formed on an image bearing member is first transferred to an intermediate transfer member, and then transferred to a transfer material to obtain image formation.

An image forming apparatus using an intermediate transfer member is an apparatus for obtaining a full color image formation (a copy or a print). This is attained by repeating a process of primarily transferring a toner image (that is, a visible image) formed on a photosensitive member (an image bearing member for toner images of a plurality of colors), and then secondarily transferring the primarily transferred toner images collectively to a recording material such as paper (a transfer material).

A known image forming apparatus of this type is the one employing an intermediate transfer belt. This image forming apparatus is provided with a plurality of image forming portions (stations) of yellow (Y), magenta (M), cyan (C) and black (K) along the intermediate transfer belt. Each image forming portion has a photosensitive drum (a drum-shaped electrophotographic photosensitive member) as an image bearing member.

An image is formed by uniformly charging a surface of a photosensitive drum by a primary charger, forming an electrostatic latent image on the photosensitive drum by exposing an image pattern using an exposure device, and developing the latent image by a developing device to visualize it as a toner image.

Toner images of four colors formed on a plurality of photosensitive drums in this way are primarily transferred onto the intermediate transfer belt while being superimposed over it in a primary transfer portion, in which the photosensitive drums and the intermediate transfer belt contact, by supplying transfer charge from primary transfer means contacting the intermediate transfer belt. Then, a secondary transfer portion is formed by contacting secondary transfer means, which was separated from the intermediate transfer belt, with the intermediate transfer belt, and transfer charge is supplied by the secondary transfer means. The toner images of four colors on the intermediate transfer belt are thereby secondarily transferred collectively onto a recording material such as paper supplied to a secondary transfer portion.

Successively, the recording material on which the toner images of four colors have been transferred is conveyed to a fixing device. A full-color image is formed on the recording material by mixing the toner images of four colors and simultaneously fixing them on the recording material while they are passing through the fixing device.

Toner remains on the intermediate transfer belt by the secondary transfer. A cleaning bias impressing roller, which was separated from the intermediate transfer belt during the image formation on the intermediate transfer belt, contacts the intermediate transfer belt, and is charged in a positive polarity opposite to a normal charging polarity of the toner.

This secondary transfer residual toner is thereby transferred to the photosensitive drum in the primary transfer portion when it reaches the primary transfer portion by the movement of the intermediate transfer belt. Then, the secondary transfer residual toner is collected in the same manner as primary transfer residual toner by cleaning means of the photosensitive drum.

Incidentally, in recent years, in order to miniaturize an image forming apparatus and save energy consumed by the same, it has been attempted to devise an image forming apparatus without a cleaner for the photosensitive drum by employing a system of cleaning simultaneous with developing. However, the above mentioned conventional image forming apparatus has the following problems.

If there is no drum cleaner, it is likely that a primary charger will be stained because transfer residual toner or re-transfer toner after passing a primary transfer nip portion may become stuck to the primary charger via the photosensitive drum. In order to prevent such a stain, it is necessary to transfer the transfer residual toner or the like from the photosensitive drum onto the intermediate transfer belt in the primary transfer portion and collect it using cleaning means or the like of the intermediate transfer belt.

However, there is a case in which, when transfer charge is being supplied to the primary transfer means provided in each station, for example, an emergency stop operation for image formation may be taken only in the yellow station, the transfer charge continues to be supplied in the primary transfer portion in the magenta station, the cyan station, and even the primary transfer portion of the black station that follows the yellow station as subsequent image formation processes, as in the yellow station. This becomes a factor for reducing an operating life of the photosensitive drum. In addition, this re-transfers a toner image formed in the yellow station to a photosensitive member in the downstream side, which possibly becomes a factor for mixed colors.

FIG. 7 shows a relationship between a transfer residual rate and a re-transfer rate with respect to a transfer electric current value. Here, the transfer residual rate is a ratio of a transfer residual toner density on the photosensitive drum to a sum of a toner density on the intermediate transfer member and a transfer residual toner density on the photosensitive drum after a solid image formed on the photosensitive drum is primarily transferred onto the intermediate transfer member. In addition, the re-transfer rate is a ratio of a re-transfer toner density on the photosensitive drum of a next primary transfer portion to a sum of a toner density on the intermediate transfer member and a re-transfer toner density on the photosensitive drum of the next primary transfer portion after a solid image transferred to the intermediate transfer member in the primary transfer portion passes the next primary transfer portion. Both of these toner densities are measured by a densitometer (type number 404) manufactured by X-rite Incorporated.

In the case of an image forming apparatus that is not provided with a cleaner in a photosensitive drum, the amount of toner on the photosensitive drum after an image passes a primary transfer portion of each station must be as small as possible. However, there is an optimum primary transfer electric current value (e.g., 22 $\mu$A in FIG. 7) for minimizing a transfer residual rate, and transfer electric current must be made small in order to minimize a re-transfer rate. Thus, it is difficult to minimize both the transfer residual rate and the re-transfer rate at a single transfer electric current value.

SUMMARY OF THE INVENTION

Therefore, it is an object of the present invention to provide an image forming apparatus that, in forming an image on a transfer material via a plurality of image bearing members and an intermediate transfer member, even if an emergency stop operation for image formation is taken due to a failure of transfer material conveyance, an image formation error or the like, prevents a stain of charging means of an image bearing member or that of secondary transfer means due to a toner image existing on the image bearing member, and further is capable of realizing the extension of an operating life of the image bearing member and the prevention of mixed colors between one image forming portion and the other image forming portion.

In order to attain the above-mentioned object, an image forming apparatus comprises:

a plurality of image bearing members;

a plurality of image forming means for forming an image on the plurality of image bearing members;

a plurality of primary transfer means for transferring the images on the plurality of image bearing means onto an intermediate transfer member;

secondary transfer means for transferring the image on the intermediate transfer member onto a transfer material; and control means for controlling the primary transfer means to operate until an image area on the image bearing member on which an image is being formed at the point when an image formation stop instruction is issued passes at least a transfer region in the primary transfer means opposing to the image bearing member.

In addition, an image forming apparatus in accordance with another aspect of the present invention comprises:

a plurality of image bearing members;

a plurality of image forming means for forming images on the plurality of image bearing members;

a plurality of primary transfer means for transferring the images on the plurality of image bearing members onto an intermediate transfer member;

secondary transfer means for transferring the images on the intermediate transfer member onto a transfer material; and control means for controlling the plurality of primary transfer means to operate until an image area on an image bearing member on which an image is being formed at the point when an image formation stop instruction is issued at least passes a transfer region in primary transfer means opposing to the image bearing member, and controlling the secondary transfer means not to operate or controlling the secondary transfer means so that an electric field opposite to that which was generated at the time of transfer operation is generated when the image area transferred onto the intermediate transfer member by the operation of the primary transfer means passes at least a transfer region in the secondary transfer means.

DESCRIPTION OF THE PREFERRED EMBODIMENTS

Figure 1:
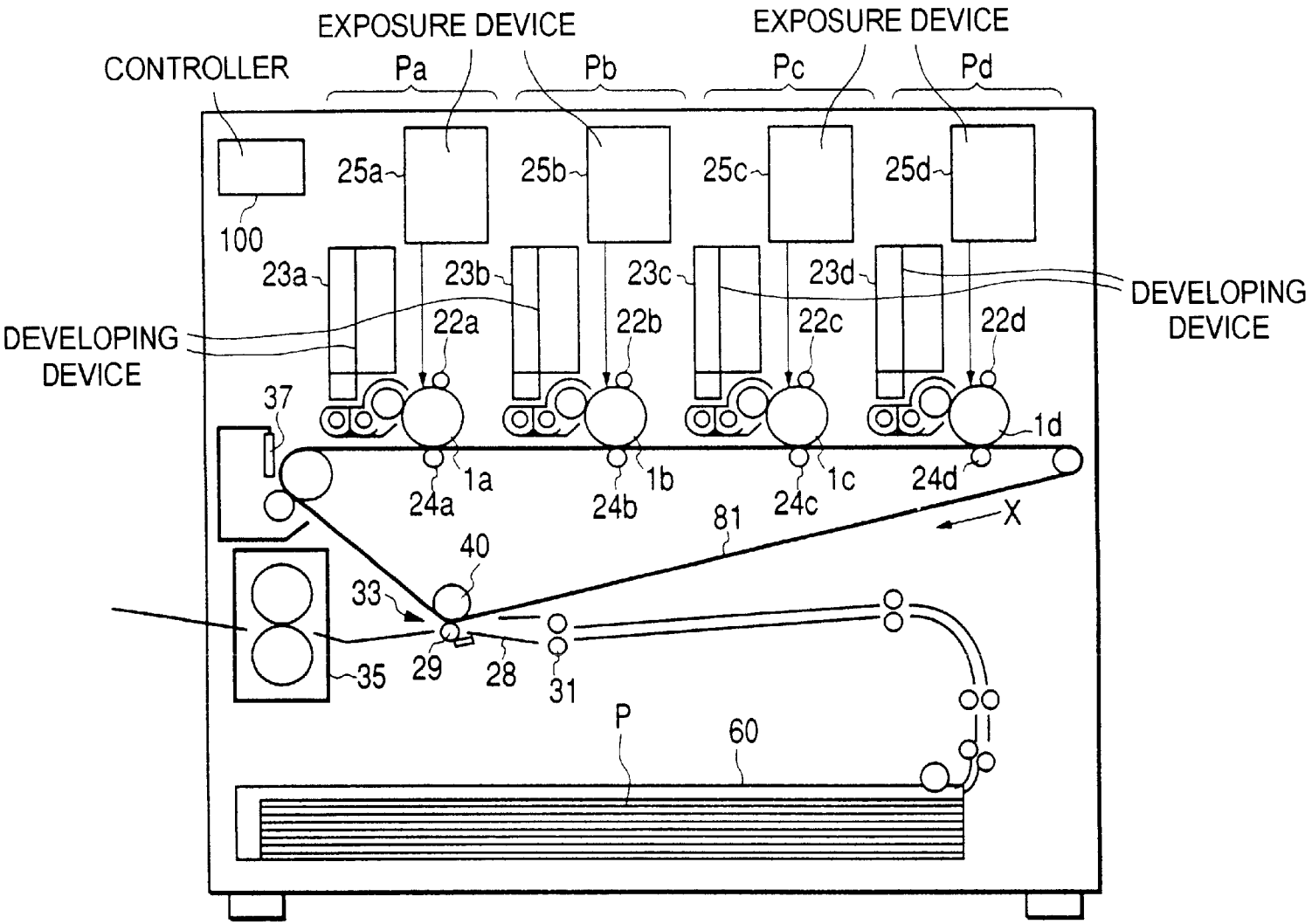
FIG. 1 is a schematic sectional view showing an embodiment of an image forming apparatus of the present invention.

Embodiments in accordance with the present invention will be described further in detail with reference to the drawings. In the following description of the embodiments, reference is made to drawing figures. Like reference numerals used throughout the several figures refer to like or corresponding parts.

First Embodiment

FIG. 1 is a schematic sectional view showing an embodiment of an image forming apparatus of the present invention.

An endless intermediate transfer belt 81 that runs in a direction indicated by an arrow X is provided in a main body of the image forming apparatus. This intermediate transfer belt 81 is formed of a film of dielectric resin such as polycarbonate, polyethylene terephthalate, polyvinylidene fluoride, polyimide and ethylene tetrafluoride ethylene polymer. Although a polyimide seamless belt with a volume resistivity of $10^9$ Ωcm (measured with impressed voltage of 500 V and impressing time of 60 seconds using a probe conforming to the method of JIS-K6911) and a thickness t=80 μm is employed in this embodiment, a belt of another material, volume resistivity and thickness may be employed.

Four image forming portions (stations) Pa, Pb, Pc and Pd are arranged in series above the intermediate transfer belt 81. These image forming portions Pa, Pb, Pc and Pd are configured similarly except that they form toner images of magenta, cyan, yellow and black, respectively.

The configurations of the image forming portions will be described referring to the image forming portion Pa as an example. The image forming portion Pa is provided with a drum-shaped electrophotographic photosensitive member, that is, a photosensitive drum 1*a*, rotatably arranged therein. Around the photosensitive drum 1*a*, there are arranged process devices such as a primary charger (charging roller) 22*a*, an exposure device 25*a* and a developing device 23*a*. Concerning the other image forming portions Pb, Pc and Pd, the suffixes of the reference numerals given to the photosensitive drums and the other devices are replaced with b, c and d, respectively. Magenta toner, cyan toner, yellow toner and black toner are contained in the developing devices 23*a*, 23*b*, 23*c* and 23*d*, respectively, which are arranged in the image forming portions Pa, Pb, Pc and Pd.

An image signal according to a magenta component color of an original is irradiated on the photosensitive drum 1*a* of the image forming portion Pa via a polygon mirror (not shown) or the like by the exposure device 25*a*, and a latent image is formed on the photosensitive drum 1*a*. The magenta toner is supplied from the developing device 23*a* to the latent image to develope the latent image into a magenta toner image. The magenta toner image reaches a primary transfer portion on which the photosensitive drum 1*a* and the intermediate transfer belt 81 abut against each other with the rotation of the photosensitive drum 1*a*. Then, the toner image is transferred to the intermediate transfer belt 81 by a primary transfer bias impressed on a primary transfer member (transfer roller) 24*a* (a primary transfer).

No later than a time when the intermediate transfer belt 81 bearing the magenta toner image reaches the image forming portion Pb in this way, a cyan image is formed on the photosensitive drum 1*b* with a method similar to the above. The cyan image is transferred to the magenta toner image on the intermediate transfer belt 81 in a transfer portion.

Similarly, as the intermediate transfer belt 81 moves to the image forming portion Pc and Pd, a yellow toner image and a black toner image are sequentially superimposed on the magenta toner image and the cyan toner image and transferred onto the intermediate transfer belt 81 in the respective transfer portions of the image forming portions Pc and Pd.

During this process, a recording material P is picked up from a feeding cassette 60, conveyed to the intermediate transfer belt 81 via a registration roller 31 and a guide 28, and supplied to a secondary transfer portion in which a secondary transfer roller 29 abuts against the intermediate transfer belt 81. Simultaneously, a secondary transfer bias is impressed on a secondary transfer opposite roller 40 as a secondary transfer member inside the intermediate transfer belt 81, and toner images of four colors on the intermediate transfer belt 81 are collectively transferred onto the recording material P (a secondary transfer).

The recording material P onto which the toner images of four colors are transferred is separated from the intermediate transfer belt 81 at a separating portion 33 and conveyed to a fixing device 35. The fixing device 35 mixes the colors of the toner and fixes the toner by heat and pressure. As a result, a full-color image is formed on the recording material P.

Transfer residual toner remaining on the photosensitive drum 1 initially adheres to the charger 22*a*. However, the transfer residual toner is returned onto the photosensitive drum 1*a* between a sheet and another sheet, or at the time of pre-rotation or post-rotation of image formation. Then, the transfer residual toner is transferred to the intermediate transfer belt 81 and collected by a belt cleaner 37.

Each of the above-mentioned operations of the image forming apparatus is controlled by a controller (control means 100).

A characteristic of the present invention is that a method has been devised for coping with the case in which image formation is stopped in an emergency, such as due to a conveyance failure of the recording material P, an image formation error or the like in the above-mentioned image forming apparatus.

Figure 2A:
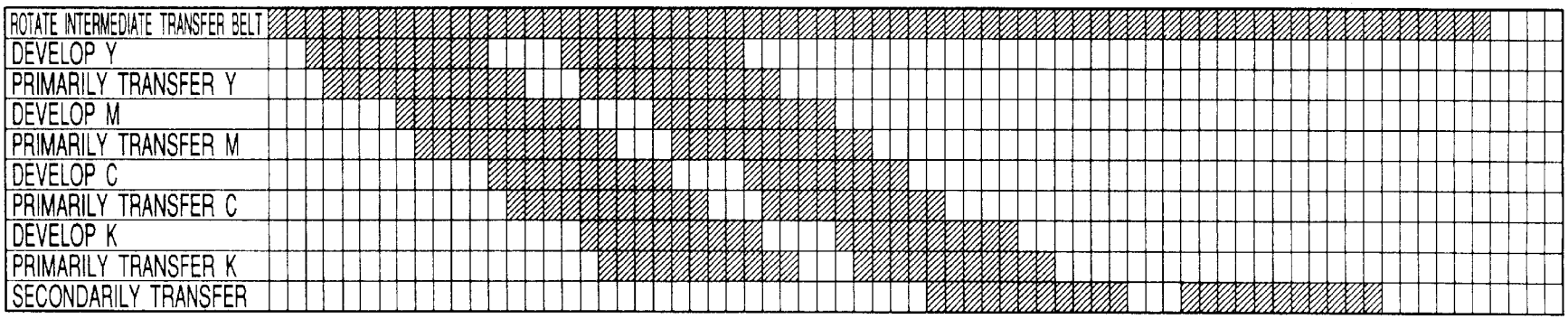
FIGS. 2A, 2B, 2C and 2D are sequence illustrations showing a method in the embodiment of FIG. 1.
Figure 2B:
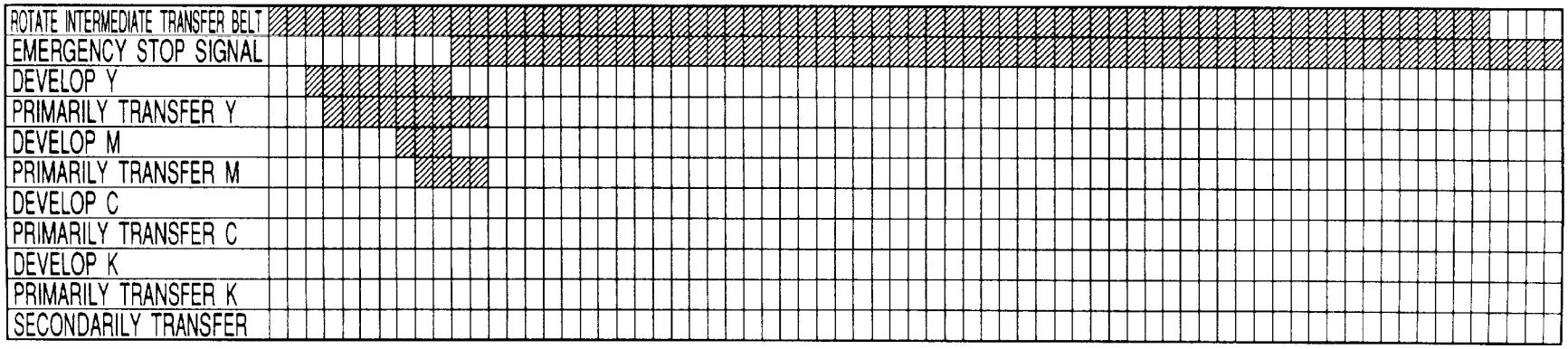
Figure 2C:
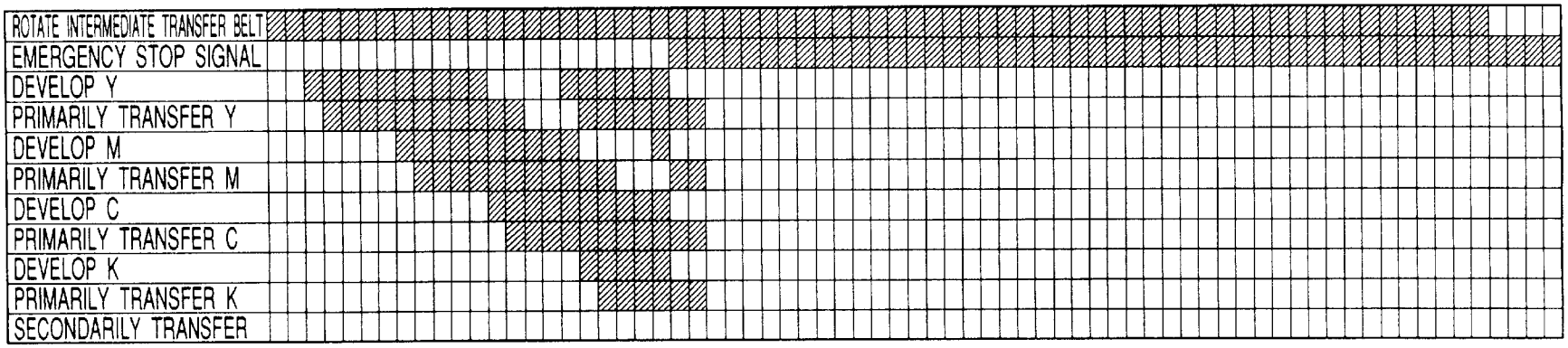
Figure 2D:
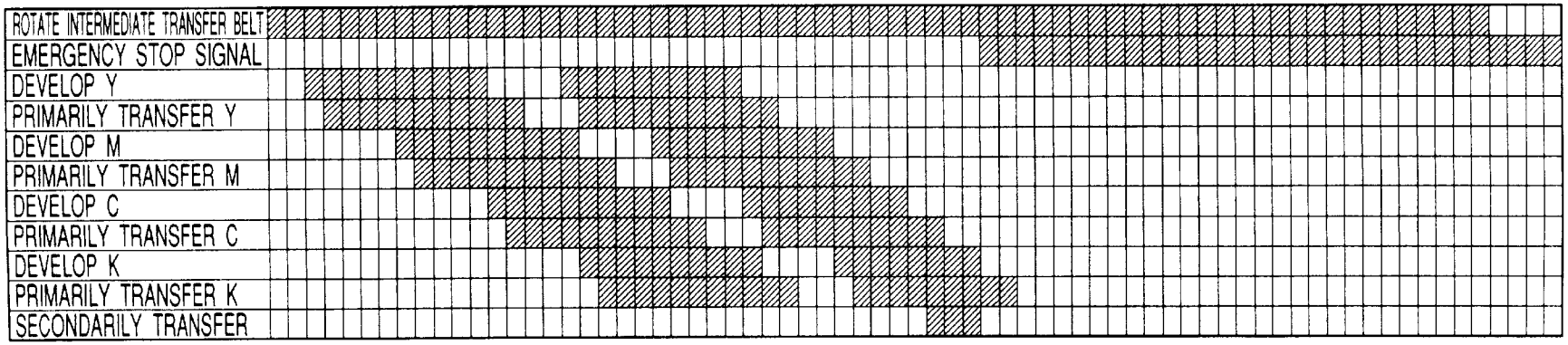

Sequence illustrations showing a method of this embodiment are shown in FIGS. 2A, 2B, 2C and 2D. FIGS. 2A to 2D show a part of bias impression or the like relating to this embodiment with image forming operation of two sheets of A4 size as an example. FIG. 2A shows normal image forming operation, and FIGS. 2B, 2C and 2D show operations when emergency stop is instructed during the normal image forming operation.

If an emergency stop signal for stopping image forming operation is generated due to a conveyance failure of a recording material, the chargers 22*a* to 22*d*, the exposure devices 25*a* to 25*d* and the developing devices 23*a* to 23*d* of all the stations Pa to Pd are immediately stopped at that point (however, any one of those which have not yet been activated maintains a stop state without being activated). In this way, an amount of toner adhering to the photosensitive drums 1*a* to 1*d* can be minimized.

Photosensitive drums 1*a* to 1*d*, the intermediate transfer belt 81, the primary transfer rollers 24*a* to 24*d*, and the secondary transfer roller 29 maintain the rotating state for a while. And, in order to transfer a toner image being formed on a photosensitive drum, when an emergency stop signal for stopping the above-mentioned image forming operation is generated, to the intermediate transfer belt 81 at the primary transfer portion, transfer charge is impressed on a primary transfer roller and supplied to the photosensitive drum (FIGS. 2B, 2C and 2D). In addition, at the time when the emergency stop signal is generated, if transfer charge is being impressed on the secondary transfer opposite roller 40, the impression of transfer charge is immediately stopped (FIG. 2D).

Here, the primary transfer roller on which transfer charge is impressed is only that in a station in which a toner image exists on the photosensitive drum. It is sufficient that the supplied transfer charge is enough for transferring the toner image formed on the photosensitive drum onto the intermediate transfer belt 81, and transfer charge need not be supplied to a region other than the toner image.

The surface of the photosensitive drum tends to be abraded when transfer charge is supplied, which may affect the durability of the photosensitive drum or generate an electric memory on the photosensitive drum. Therefore, it is desirable to minimize the required supply of transfer charge to the photosensitive drums 1*a* to 1*d*.

The toner image transferred onto the intermediate transfer belt 81 thereafter moves to the secondary transfer portion. In this embodiment, it is not necessary to separate the secondary transfer roller 29 from the intermediate transfer belt 81 because a system is employed in which the four photosensitive drums 1*a* to 1*d* are arranged in tandem and a toner image is transferred to a recording material via the intermediate transfer belt 81. A separating mechanism is not provided also because shock unevenness is generated in an image due to separation, and a detaching and attaching mechanism is required in the separating mechanism, which may cause degradation or the like.

Therefore, it is particularly effective not to supply transfer charge to the secondary transfer portion of such an image forming apparatus as described above in preventing a toner image generated at the time of emergency stop from adhering to the secondary transfer roller 29.

Although supply of charge is stopped in the secondary transfer portion in this embodiment, bias having the same polarity as toner's polarity may be impressed on the secondary transfer roller 29, or bias having the reversed polarity of toner's polarity may be impressed on the secondary transfer opposite roller 40 in order to realize the same effect.

Figure 3:
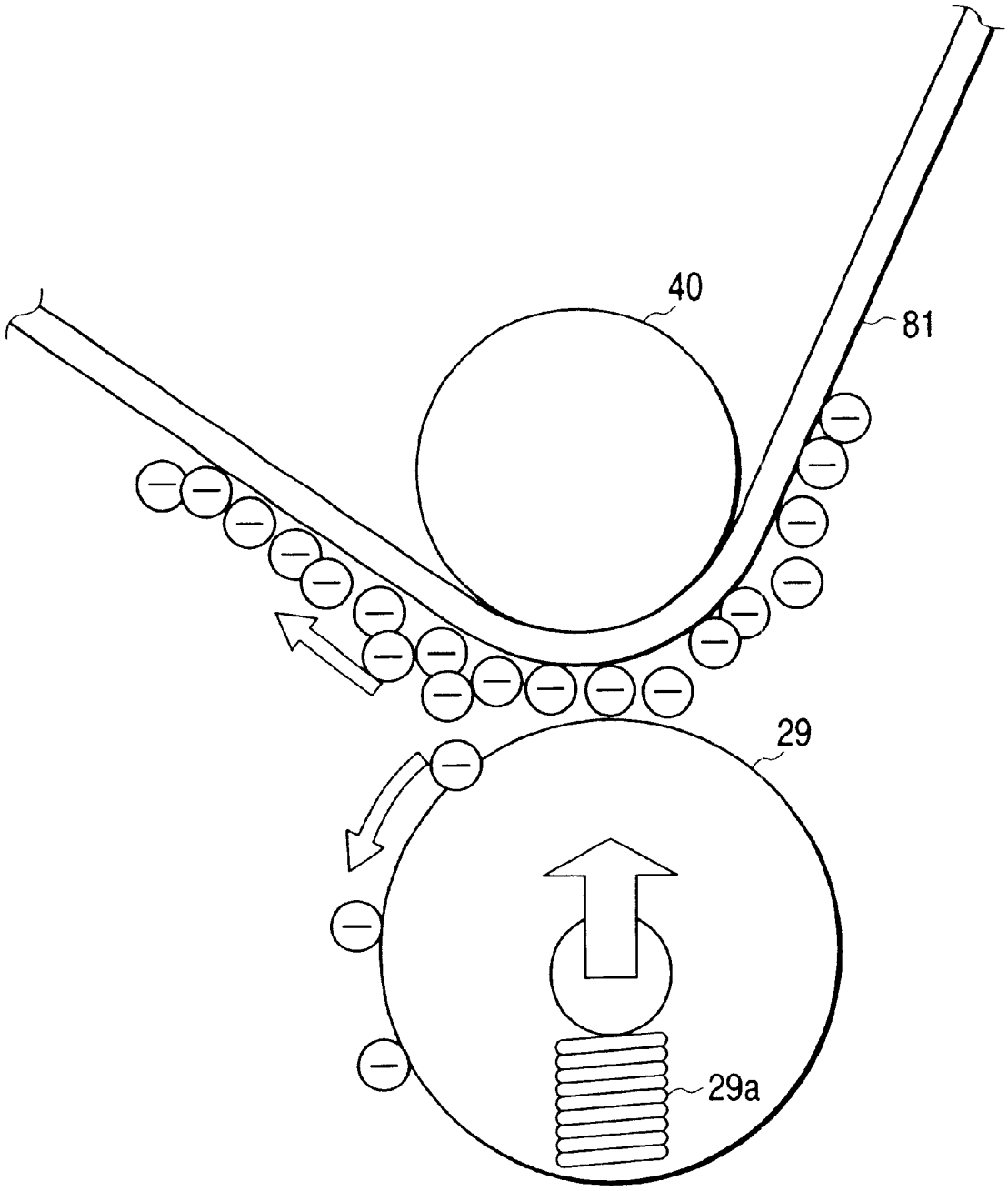
FIG. 3 is an explanatory view showing behaviors of toner in a secondary transfer portion in the embodiment of FIG. 1.
Figure 4A:
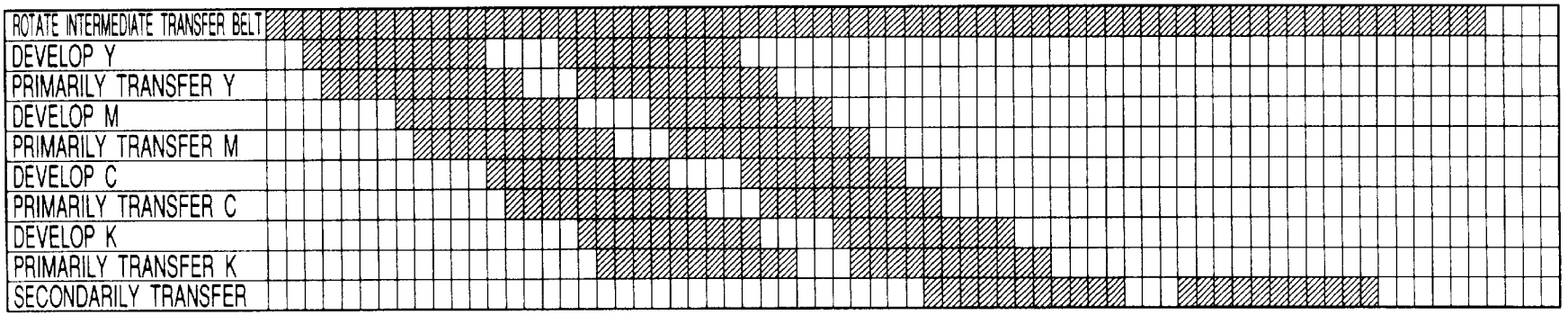
FIGS. 4A, 4B, 4C and 4D are sequence illustrations showing a method in another embodiment of the present invention.
Figure 4B:
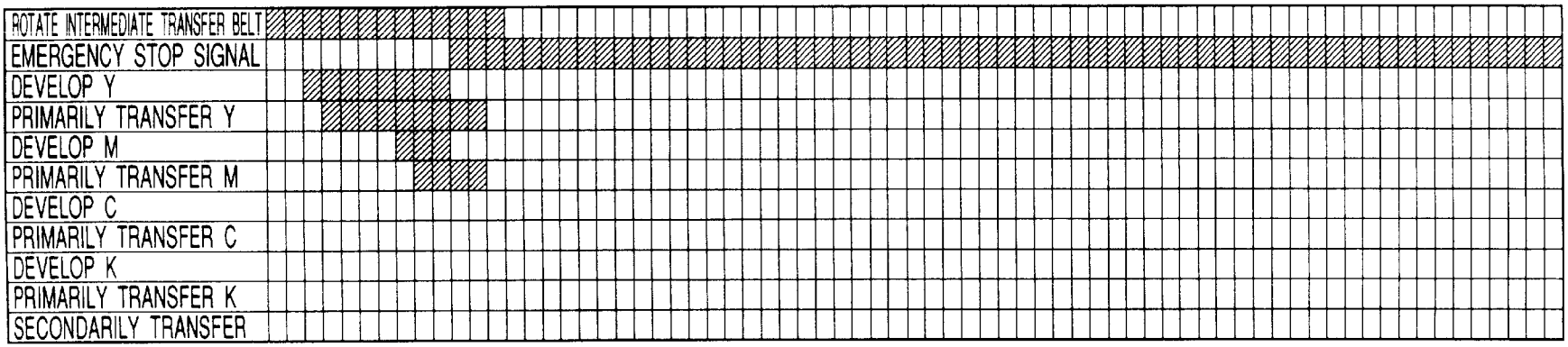
Figure 4C:
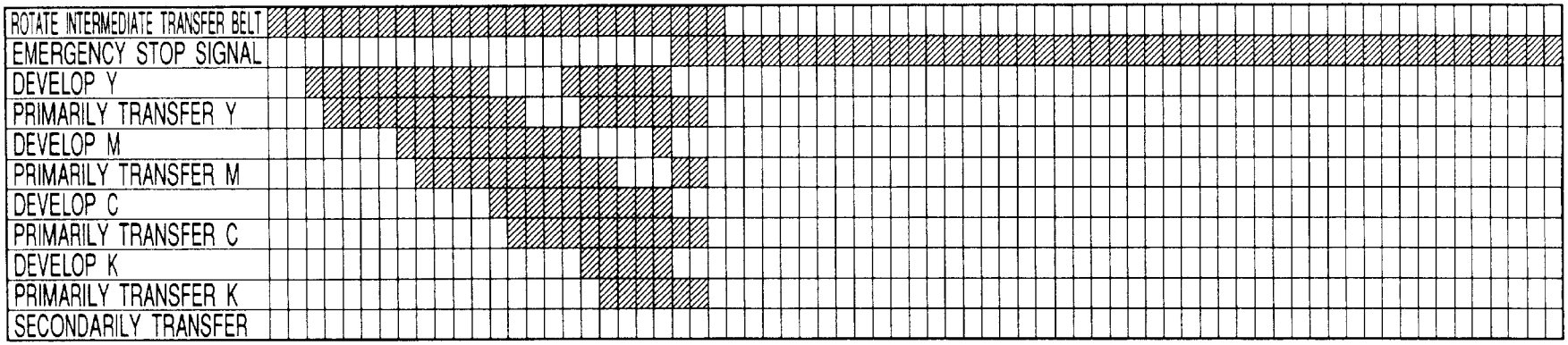
Figure 4D:
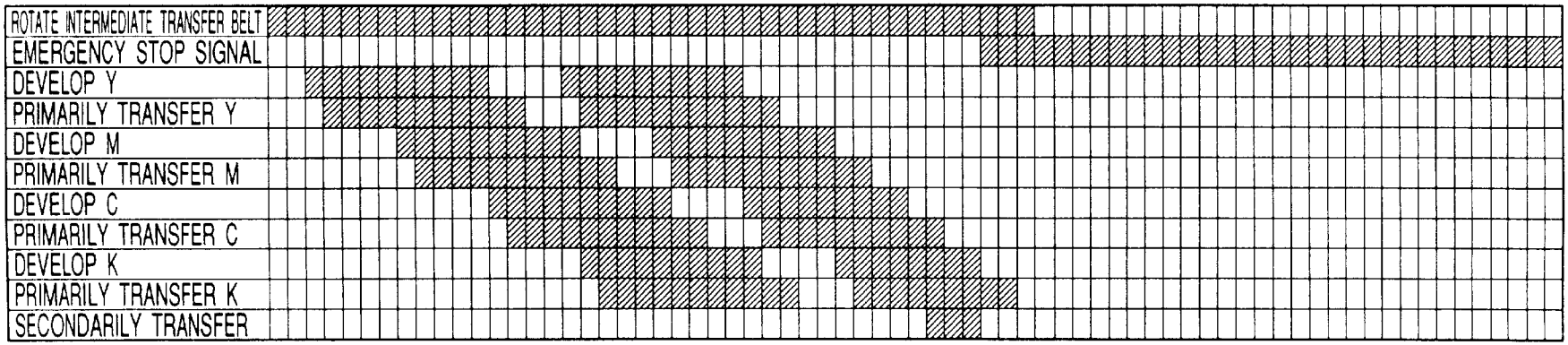

In this embodiment, a toner image transferred onto the intermediate transfer belt 81 hardly adheres to the secondary transfer roller 29 as shown in FIG. 3, and most part of the toner passes through the secondary transfer portion to reach a belt cleaner 37 of the intermediate transfer belt 81, where the toner is removed. The intermediate transfer belt 81 stops its rotation when the trailing end of the toner image has passed the part of the belt cleaner 37. In FIG. 3, reference numeral 29*a* denotes a spring that presses a core metal of the secondary transfer roller 29 and causes the secondary transfer roller 29 to abut against the intermediate transfer belt 81.

Further, causes other than the above-mentioned conveyance failure of a recording material may be a condition for taking the emergency stop operation. Outlines of such causes will be described below.

Short-circuit of a circuit board or wiring

Disconnection of an intra-machine heater such as a fixing heater, a drum heater and a cassette heater Detection of an abnormality by a toner density sensor of a station (in this embodiment, when a ratio of toner and carrier is detected in each of the developing devices 23*a* to 23*d* and this ratio exceeds a certain range)

Detection of an error by an electrostatic voltmeter of a certain station (when an electrical potential on the photosensitive drum 1 is monitored and the electrical potential significantly deviates from a predetermined electrical potential)

Detection of an error in a driving system (load or the like)

Since this embodiment is configured as described above, a toner image on the photosensitive drum can be efficiently transferred to the intermediate transfer belt, and can be conveyed and processed without being re-transferred to the photosensitive drum when image forming operation is stopped for emergency due to a conveyance failure of a recording material, an image formation error or the like. In addition, a toner stain of the secondary transfer roller can be prevented and toner can be efficiently collected by the cleaner of the intermediate transfer belt. Moreover, an amount of transfer charge supplied to the photosensitive drum can be minimized. As a result, an operating life of the photosensitive drum can be extended and running costs can be reduced.

Second Embodiment

This embodiment is applied to the image forming apparatus of FIG. 1. FIGS. 4A, 4B, 4C and 4D show sequences of a part of bias impression or the like relating to this embodiment.

The sequences of FIGS. 4A to 4D are different from the sequences of FIGS. 2A to 2D of the first embodiment in that rotation of the intermediate transfer stops in the minimum possible time after the emergency stop signal is turned ON.

This embodiment is characterized in that the chargers 22*a* to 22*d*, the exposure devices 25*a* to 25*d* and the developing devices 23*a* to 23*d* of all the stations Pa to Pd are stopped immediately after receiving an emergency stop signal for stopping image forming operation due to a conveyance failure of a recording material, an image formation error or the like, in which case all the operations are stopped upon a trailing end of a toner image formed on the photosensitive drum passing the primary transfer portion.

However, charge is supplied at the primary transfer portion until the trailing end of the toner image passes the primary transfer portion. This is for making it possible to stop the rotational operation as soon as possible to advance to a jam clearance operation or an image formation error releasing operation. When the jam clearance or the image formation error is released, the image forming operation is changed from the emergency stop to a returning operation. At this point, since charge is not supplied at the secondary transfer portion, a toner stain of the secondary transfer roller 29 is restrained to a minimum.

It is needless to say that, in this embodiment, bias having the same polarity as toner's polarity may be impressed on the secondary transfer roller 29, or bias having the reversed polarity of toner's polarity may be impressed on the secondary transfer opposite roller 40 at this point as in the first embodiment.

According to this embodiment, as in the first embodiment, a toner image on the photosensitive drum can be efficiently transferred to the intermediate transfer belt, and can be conveyed and processed without being re-transferred to the photosensitive drum when image forming operation is stopped for emergency due to a conveyance failure of a recording material, an image formation error or the like. Therefore, a toner stain of the secondary transfer roller can be prevented and toner can be efficiently collected by the cleaner of the intermediate transfer belt. Moreover, an amount of transfer charge supplied to the photosensitive drum can be minimized. As a result, an operating life of the photosensitive drum can be extended and running costs can be reduced.

Third Embodiment

Figure 5:
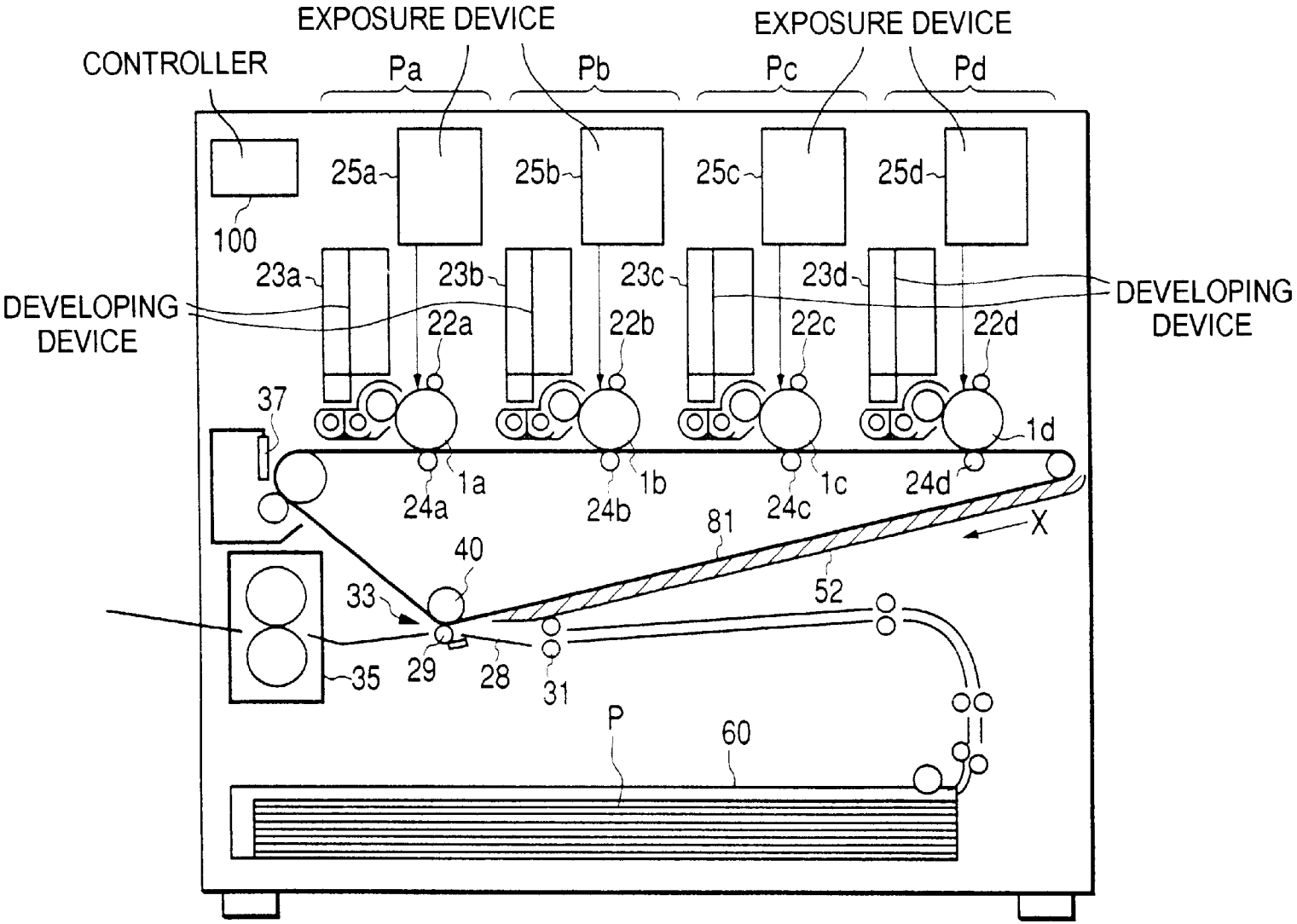
FIG. 5 is a schematic sectional view showing yet another embodiment of the image forming apparatus of the present invention.
Figure 6A:
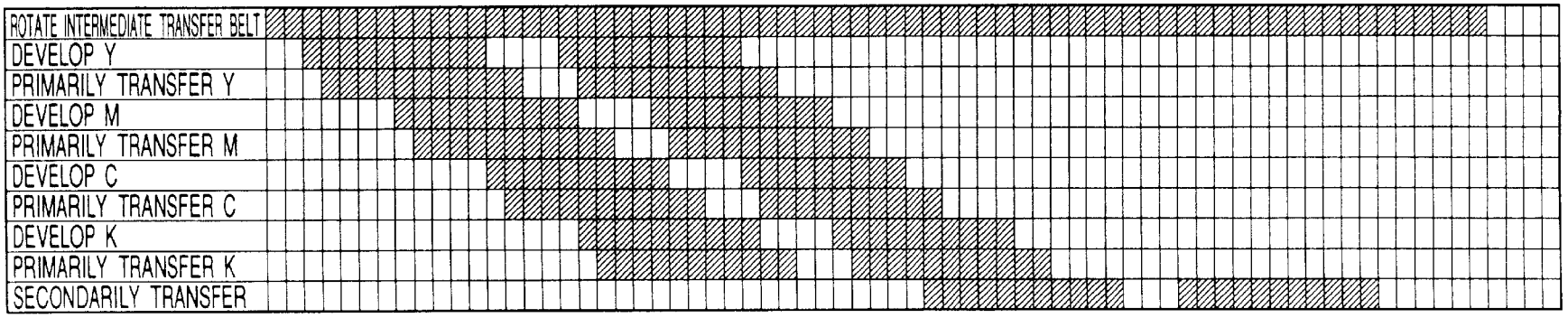
FIGS. 6A, 6B, 6C and 6D are sequence illustrations showing a method in the embodiment of FIG. 5.
Figure 6B:
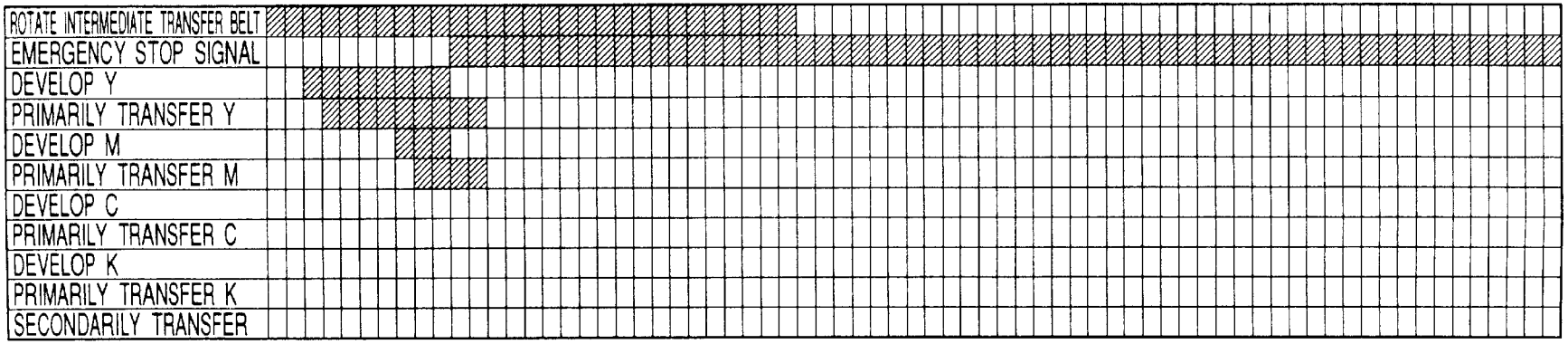
Figure 6C:
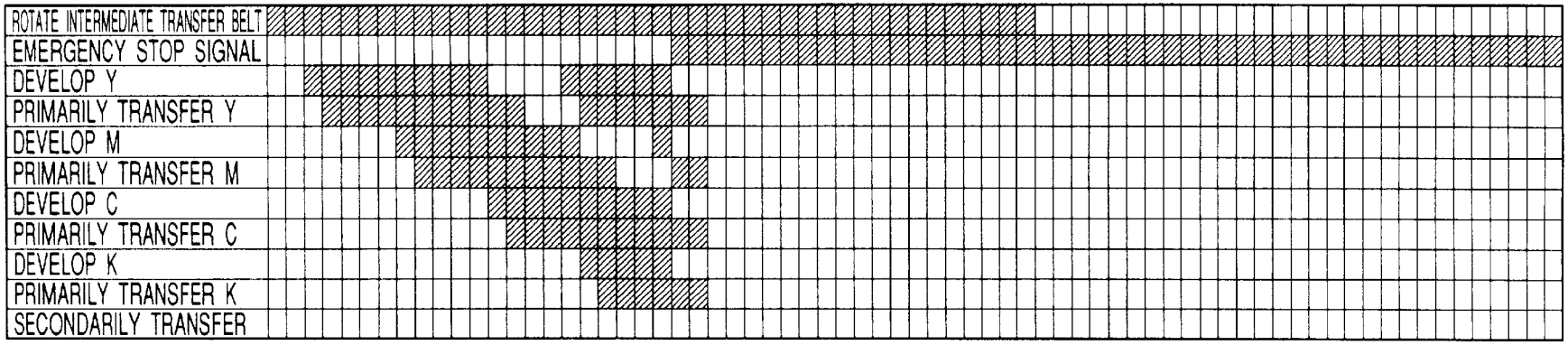
Figure 6D:
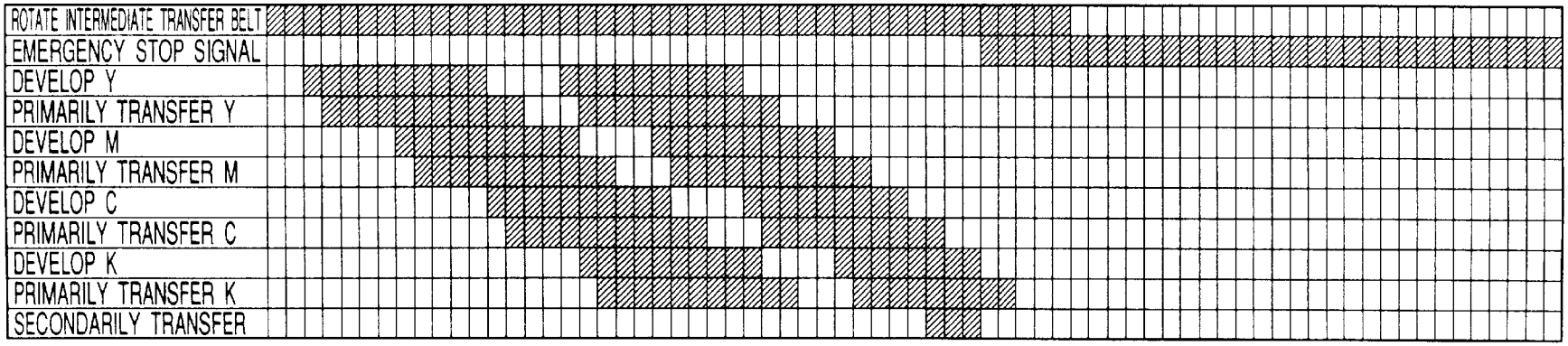
Figure 7:
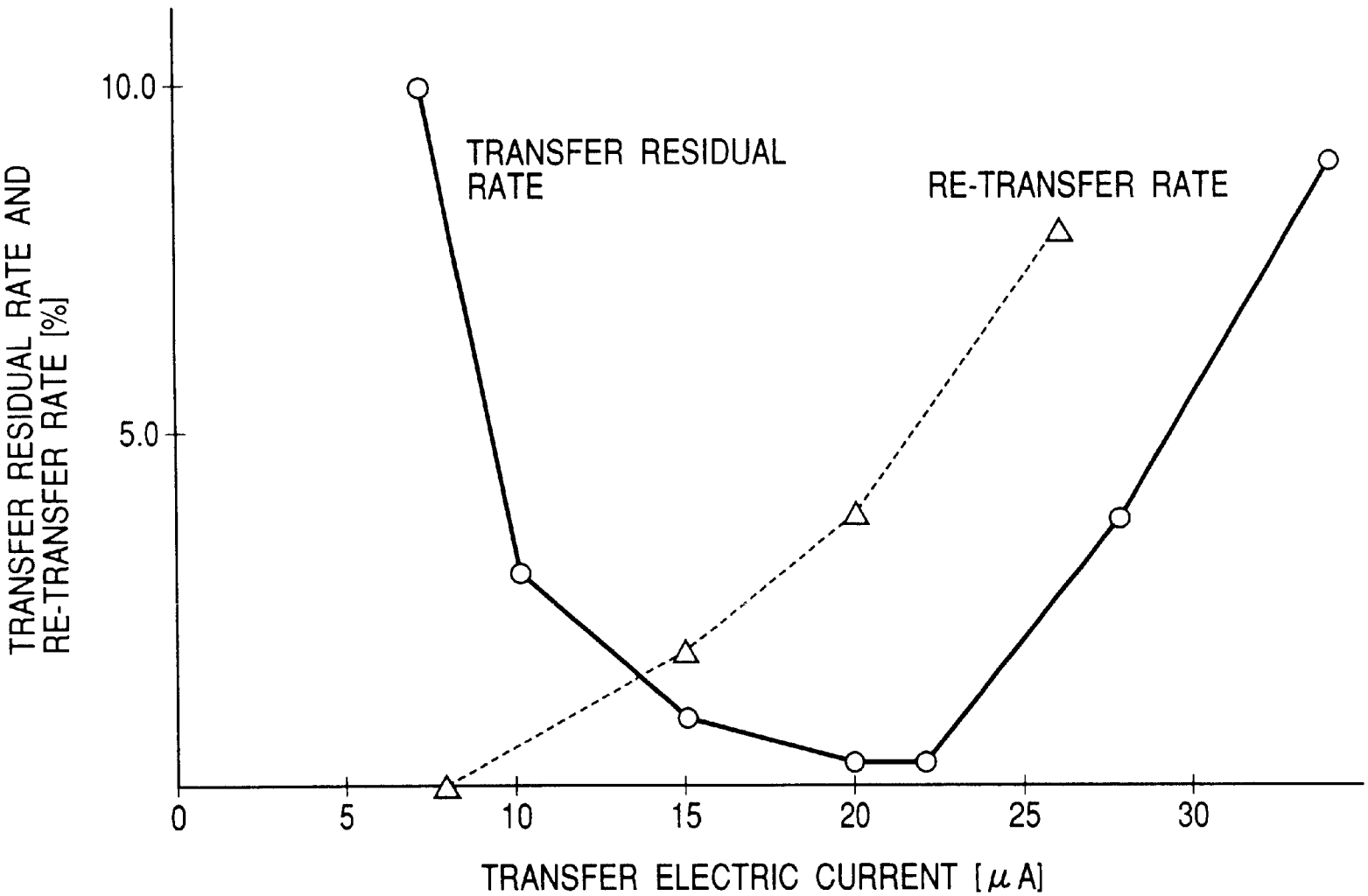
FIG. 7 is a graph showing a relationship between a transfer residual rate and a re-transfer rate with respect to a primary transfer current in a primary transfer portion.

FIG. 5 is a schematic sectional view showing another embodiment of an image forming apparatus of the present invention.

In this embodiment, a cover 52 is installed along the outer surface of the intermediate transfer belt 81 at a predetermined position of the intermediate transfer belt 81, more specifically, at a position, which is marked with diagonal lines in FIG. 5, between the downstream of the first transfer portion and the upstream of the secondary transfer portion of the image forming portion Pd of the final color in the image forming apparatus shown in FIG. 1 of the first embodiment.

The other mechanical configuration of the image forming apparatus of this embodiment is basically the same as the image forming apparatus of FIG. 1. In FIG. 5, those components which are identical to the components of the embodiment illustrated in FIG. 1 have been given the same numerical designation as is used in FIG. 1.

FIGS. 6A, 6B, 6C and 6D show sequences of a part of bias impression or the like relating to this embodiment. In the sequences of FIGS. 6A to 6D, rotation of the intermediate transfer belt stops in the minimum possible time after the emergency stop signal is turned ON as in the sequences of FIGS. 4A to 4D of the second embodiment. However, the sequences of the third embodiment take longer than those of the second embodiment until the rotation of the intermediate transfer belt stops. This is because a toner image is conveyed to the above-mentioned predetermined position.

In this embodiment, the chargers 22*a* to 22*d*, the exposure devices 25*a* to 25*d* and the developing devices 23*a* to 23*d* of all the stations Pa to Pd are stopped immediately after receiving an emergency stop signal for stopping image forming operation due to a conveyance failure of a recording material, an image formation error or the like. At this moment, all the operations are stopped upon a trailing end of a toner image formed on the photosensitive drum passing the primary transfer portion and the toner image entering the predetermined position (the hatched part of FIG. 5).

However, at the primary transfer portion, charge is supplied only to a station in which a toner image is formed on a photosensitive drum at the time of emergency stop. This is for making it possible to stop the rotational operation as soon as possible to advance to a jam clearance operation and an image formation error releasing operation, and for preventing the toner image from contacting the outside environment when the intermediate transfer belt unit or the like is removed from the image forming apparatus. The cover 52 prevents the toner image from being exposed to the outside environment by temporarily stopping the toner image on the intermediate transfer belt 81, which was generated at the time of the emergency stop, in the hatched part of FIG. 5.

When the jam clearance or the image formation error is released, the image forming operation is changed from the emergency stop to a returning operation, and the rotation of the intermediate transfer belt 81 is started. At this point, when the temporarily stopped image moves to the secondary transfer portion, charge is not supplied at the secondary transfer portion. As a result, a toner stain of the secondary transfer roller 29 is restrained to a minimum.

It is needless to say that, in this embodiment, bias having the same polarity as toner's polarity may be impressed on the secondary transfer roller 29, or bias having the reversed polarity of toner's polarity may be impressed on the secondary transfer opposite roller 40 at this point as in the first and the second embodiments.

A timing for stopping the toner image generated at the time of the emergency stop is fixed in the above-mentioned first through third embodiments. However, the present invention is not limited to this, and the timing for stopping the toner image may be changed according to a condition. For example, the condition is such as the case in which the image forming apparatus has at least two or more modes such as a printer mode, a copy code and the like.

In the printer mode, assuming that a user is not near the image forming apparatus, if the image forming apparatus performs the emergency stop operation, the toner image generated at the time of the emergency stop is stopped after the trailing end of the toner image passes the intermediate transfer belt cleaner as in the first embodiment. In this way, if the surface of the intermediate transfer belt is cleaned to wait for a user to perform the jam clearance and the image formation error release operation, problems such as a stain, sticking or the like by leaving the toner image on the intermediate transfer belt for a long time can be prevented. In addition, in the copy mode, assuming that the image forming apparatus is in the state in which a user can immediately perform the jam clearance or the image formation error release operation, the rotational operation is stopped as soon as possible as in the second and the third embodiments.

In addition, the timing for stopping the toner image may be changed according to a location where a recording material is jammed. For example, in the case of a separation failure at the secondary transfer portion, or in the case that a recording material jam in the fixing device or the like occurs, it is desirable to stop the toner image as soon as possible (the second and the third embodiments). On the other hand, if a paper feeding failure such as a pickup failure of a recording material from a cassette occurs, it is also effective to clean the surface of the intermediate transfer belt (the first embodiment) to wait for a user's processing.

In addition, the timing for stopping the toner image may be changed according to a formed image size or the like. The toner image can be stopped at an optimal position according to a condition. This can be attained by stopping the toner image after cleaning all the toner on the intermediate transfer belt (the first embodiment) if the formed image size is so large that the image cannot be included in the hatched part of FIG. 5, or temporarily stopping the toner image in the hatched part (the third embodiment) if the image can be included in the hatched part.

As described above, a toner image generated at the time of emergency stop can be stopped in an optimal state under each condition by changing the timing for stopping the toner image according to a condition.

What is claimed is:

1. An image forming apparatus, comprising:

a plurality of image bearing members;

a plurality of image forming means for forming images on said plurality of image bearing members;

a plurality of primary transfer means for transferring the images on said plurality of image bearing members onto an intermediate transfer member;

secondary transfer means for transferring the images on said intermediate transfer member onto a transfer material; and control means for controlling drive operations of said plurality of image bearing members and said intermediate transfer member, and operations of said plurality of image forming means, said plurality of primary transfer means and said secondary transfer means, wherein an image formation emergency stop state for stopping an image forming operation is performed by stopping the drive operations of said plurality of image bearing members and said intermediate transfer member, and the operations of said plurality of image forming means, said plurality of primary transfer means and said secondary transfer means in response to an image formation emergency stop instruction, and wherein prior to performing an image formation stop state, said control means controls an image bearing member and said intermediate transfer member so as to drive said image bearing member and said intermediate transfer member, and controls primary transfer means so as to make said primary transfer means operative at least until an image area on said image bearing member on which an image is being formed at a time when said control means receives the image formation emergency stop instruction passes a transfer region in said primary transfer means opposing said image bearing member.

2. An image forming apparatus according to claim 1, wherein said control means controls primary transfer means in a transfer region on a downstream side in a moving direction of said intermediate transfer member to make said primary transfer means inoperative when said image area transferred onto said intermediate transfer member passes said transfer region on said downstream side.

3. An image forming apparatus according to claim 1 or 2, further comprising charging means for charging said plurality of image bearing members and developing means for developing latent images on said plurality of image bearing members by developers, wherein said developing means collects said developers on said plurality of image bearing members.

4. An image forming apparatus comprising:

a plurality of image bearing members;

a plurality of image forming means for forming images on said plurality of image bearing members;

a plurality of primary transfer means for transferring the images on said plurality of image bearing members onto an intermediate transfer member;

secondary transfer means for transferring the images on said intermediate transfer member onto a transfer material; and control means for controlling drive operations of said plurality of image bearing members and said intermediate transfer member, and operations of said plurality of image forming means, said plurality of primary transfer means and said secondary transfer means, wherein an image formation emergency stop state for stopping an image forming operation is performed by stopping the drive operation of said plurality of image bearing members and said intermediate transfer member, and the operations of said plurality of image forming means, said plurality of primary transfer means and said secondary transfer means in response to an image formation emergency stop instruction, and wherein prior to performing an emergency stop state, said control means controls an image bearing member and said intermediate transfer member so as to drive said image bearing member and said intermediate transfer member, and controls primary transfer means so as to make said primary transfer means operative at least until an image area on said image bearing member on which an image is being formed at a time when said control means receives the image formation emergency stop instruction passes a transfer region in said primary transfer means opposing said image bearing member, and controls said secondary transfer means so as to make said secondary transfer means inoperative or controls said secondary transfer means so that an electric field opposite to that which is generated at a time of transfer operation is generated when the image area transferred onto said intermediate transfer member by the operation of said primary transfer means passes at least a transfer region in said secondary transfer means.

5. An image forming apparatus according to claim 4, wherein said control means controls primary transfer means in a transfer region on a downstream side in a moving direction of said intermediate transfer member to make said primary transfer means inoperative when said image area transferred onto said intermediate transfer member by primary transfer means passes said transfer region of said primary transfer means on said downstream side.

6. An image forming apparatus according to claim 4, further comprising cleaning means for cleaning said intermediate transfer member.

7. An image forming apparatus according to claim 4, wherein said secondary transfer means abuts against said intermediate transfer member at least at a time of an image formation operation.

8. An image forming apparatus according to claim 4, wherein said secondary transfer means always abuts against said intermediate transfer member.

9. An image forming apparatus according to any one of claims 4 to 8, further comprising charging means for charging said plurality of image bearing members and developing means for developing latent images on said plurality of image bearing members by developers, wherein said developing means collects said developers on said plurality of image bearing members.

10. An image forming apparatus, comprising:

a plurality of image bearing members;

a plurality of image forming means for forming images on said plurality of image bearing members;

a plurality of primary transfer means for transferring the images on said plurality of image bearing members onto an intermediate transfer member;

secondary transfer means for transferring the images on said intermediate transfer member onto a transfer material; and control means for controlling primary transfer means to make said primary tansfer means operative at least until an image area on an image bearing member on which an image is being formed at a time when an image formation stop instruction is issued passes a transfer region in said primary transfer means opposing to said image bearing member, and controlling a movement of said intermediate transfer member so that said image area transferred to said intermediate transfer member by an operation of said primary transfer means stops at a predetermined timing.

11. An image forming apparatus according to claim 10, wherein said predetermined timing is at or after a time when a trailing end in a conveying direction of said image area passes said transfer region.

12. An image forming apparatus according to claim 10, wherein said image forming apparatus is operable in a printer mode and a copy mode, and said predetermined timing in the printer mode is different from that in the copy mode.

13. An image forming apparatus according to claim 12, wherein a stop timing in said printer mode is later than a stop timing in said copy mode.

14. An image forming apparatus according to claim 10, wherein said predetermined timing varies depending on a location where a jamming of a transfer material occurs.

15. An image forming apparatus according to claim 10, wherein said predetermined timing varies depending on an image formation size.

16. An image forming apparatus according to claim 15, further comprising protecting means for covering a part of said intermediate transfer member, wherein said predetermined timing is a timing when said image area is within said protecting means if a length in the intermediate transfer member conveying direction of said image formation size is shorter than a length in the intermediate transfer member conveying direction of said protecting means.

17. An image forming apparatus according to any one of claims 10 to 16, wherein said intermediate transfer member is re-conveyed and cleaned by cleaning means after a return instruction is issued.

18. An image forming apparatus according to any one of claims 10 to 16, further comprising charging means for charging said plurality of image bearing members and developing means for developing latent images on said plurality of image bearing members by developers, wherein said developing means collects said developers on said image bearing members.

19. An image forming apparatus according to any one of claims 10 to 16, wherein said control means controls said secondary transfer means to make said secondary transfer means inoperative or controls said secondary transfer means so that an electric field opposite to that which is generated at a time of transfer operation is generated when said image area transferred onto said intermediate transfer member by an operation of said primary transfer means passes at least a transfer region in said secondary transfer means.

* * * * *

UNITED STATES PATENT AND TRADEMARK OFFICE

CERTIFICATE OF CORRECTION

PATENT NO. : 6,477,340 B2
DATED : November 5, 2002
INVENTOR(S) : Takeshi Tomizawa et al.

It is certified that error appears in the above-identified patent and that said Letters Patent is hereby corrected as shown below:

Title page,
Item [57], ABSTRACT,
Line 3, "images of" should be deleted.

Column 4,
Line 61, "develope" should read -- develop --.

Column 5,
Line 52, "shows" should read -- shows a --.

Column 11,
Line 59, "tansfer" should read -- transfer --.
Line 63, "opposing to" should read -- opposing --.

Signed and Sealed this

Twelfth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,477,340 B2
DATED : November 5, 2002
INVENTOR(S) : Takeshi Tomizawa et al.

It is certified that error appears in the above-identified patent and that said Letters Patent is hereby corrected as shown below:

Title page,
Item [75], Inventors, "Jun Mochizuki, Shizuoka-gun (JP)" should read
-- Jun Mochizuki, Shizuoka-ken (JP) --.

Signed and Sealed this

Seventeenth Day of February, 2004

JON W. DUDAS
*Acting Director of the United States Patent and Trademark Office*